US005544610A

United States Patent [19]

Harding

[11] Patent Number: 5,544,610

[45] Date of Patent: Aug. 13, 1996

[54] CARGO SUBMARINE

[76] Inventor: David K. Harding, 88 Tilt St., Haledon, N.J. 07508

[21] Appl. No.: 982,428

[22] Filed: Nov. 27, 1992

Related U.S. Application Data

[63] Continuation of Ser. No. 781,922, Oct. 24, 1991, abandoned.

[51] Int. Cl.[6] ..... B63G 8/04

[52] U.S. Cl. ..... 114/312; 114/313; 114/321; 114/339

[58] Field of Search ..... 212/160, 198, 212/203, 190, 191, 285, 296, 307, 308; 414/139.4, 140.1, 140.4, 140.6, 142.7; 114/312, 313, 321, 332, 334, 337, 338, 341, 342, 72, 163

[56] References Cited

U.S. PATENT DOCUMENTS

| | | | |
|---|---|---|---|
| 726,947 | 5/1903 | Lake | 114/340 X |
| 1,072,397 | 9/1913 | Spear et al. | 114/340 X |
| 2,727,485 | 12/1955 | Combs | 114/16 |
| 2,972,324 | 2/1961 | Williams | 114/163 |
| 3,832,965 | 9/1974 | Walker | 114/16 R |
| 3,858,728 | 1/1975 | Fathauer | 212/160 |
| 3,903,825 | 9/1975 | Hamy | 114/77 R |
| 4,111,145 | 9/1978 | Ohsaka | 114/72 |
| 4,113,112 | 9/1978 | Ray | 212/198 X |
| 4,153,001 | 5/1979 | Krasberg | 114/312 |
| 4,350,114 | 9/1982 | Schirtzinger | 114/339 |
| 4,363,411 | 12/1982 | Blair et al. | 212/198 X |
| 4,430,652 | 2/1984 | Rothenbuhler | 212/160 X |
| 4,860,681 | 8/1989 | Svenning | 114/321 |

*Primary Examiner*—Sherman Basinger
*Attorney, Agent, or Firm*—Edward M. Livingston, Esq.

[57] ABSTRACT

A cargo submarine has a cargo section (2) between tapered peripheral buoyancy sections (2–5) and an on-board cargo-handling components (32–49) capable of rapid loading and unloading of large volumes of cargo. A hydrodynamic tower (14) conveys fresh air in and exhaust gasses out while traveling submerged sufficiently deep to avoid wave undulation. Dual electronic controls (51–57) in a tower bridge (27) and in a main bridge (50) are provided for large vessels. A crane (32) with automatically-adjustable weight balancing and electronic controls is telescoped from within the vessel. A shore ramp (47) and a ship ramp (44) are provided for fast and convenient motorized or manual handling of commercial or military cargo at beaches and shores without docks. Special hydrodynamic configuration and contouring result in less drag-per-length coefficient of marine vessels, resulting in less ton-mile propulsion costs than for optimized displacement-hull ships.

32 Claims, 5 Drawing Sheets

CARGO SUBMARINE

This is a continuation in part of application Ser. No. 07/781,922, filed 10/21/91, now abandoned.

BACKGROUND OF THE INVENTION

This invention is related to submarine vessels. In particular, it is a submarine with a cargo hold between buoyancy tanks and an on-board cargo-handling means.

Submarine technology has been limited mostly to military vessels, research vessels, marine oil-field vessels and some underwater pleasure craft. There has been relatively little development of cargo-submarine technology. However, with this invention, there are major cost, convenience, safety, cargo-handling, military and other advantages of cargo submarines over surface ships and boats of all sizes.

Examples of submarines designed for cargo transportation or having significant cargo capacity include the following U.S. patent documents.

| U.S. Pat. No. | Inventor | Issue Date |
|---|---|---|
| 4,860,681 | Svenning | August 1989 |
| 4,153,001 | Krasberg | May 1979 |
| 3,903,825 | Hamy | September 1975 |
| 3,832,965 | Walker | September 1974 |
| 2,727,485 | Combs | December 1955 |

The Svenning patent is a twin-hull oil-field submarine invented in Norway for servicing off-shore oil wells. It provides bottom hatches with specialized tools for positioning marine oil-filed equipment loaded from on-shore through a top hatch. It is limited to particular types of cargo configurations and cargo-handling tools make it unsuitable for general cargo in ways provided by this invention. The Krasberg device invented in Scotland is another form of off-shore oil-field submarine. It provides one pressurized tank for divers and one ambient-pressure tank for crew members. It is further limited to special pipe-handling equipment and tools for off-shore oil-field development and servicing. The Hamy patent describes a submarine cargo train, in which a tractor submarine is used to pull assemblies of submarine pressurized containers like an underwater barge train. Unlike the present invention, in Hamy cargo is not carried within a powered submarine and there is no on-board loading equipment. The Walker submarine, invented in Canada, for cutting through ice, is another type of submarine barge-like train. It was limited to a chassis suspended below an ice-cutting hull. The Combs patent, another barge-train submarine, describes a circular submarine body with oppositely-rotating screws at a pointed end, in which submarine barges are linked between one such pointed tractor pulling and another pushing submarine barge trains.

SUMMARY OF THE INVENTION

Objectives of this invention include the following:

Lower cost per-ton-mile for submarine cargo transportation than displacement-hull surface ships;

Lower cost for loading and unloading cargo than for surface ships;

Faster loading and unloading of cargo than for surface ships;

Lower entry-cost shipping with less expensive vessels of all sizes in proportion to carrying capacity;

Higher propulsion efficiency for small sizes by diminishing adverse effects of the marine coefficient of drag applicable to marine vehicles;

Greater safety in bad weather conditions;

Elimination of down-time from bad weather;

Comparably truck-sized transportation at lower start-up costs and competitive operating costs in comparison to large displacement-hull ships;

Convenient and fast loading and unloading without docks;

Low personnel requirements; and

Surprise-landing capability for military applications.

This invention accomplishes the above and other objectives with a cargo submarine having a cargo section between tapered peripheral buoyancy sections and an on-board cargo-handling means capable of rapid loading and unloading of large volumes of cargo. A hydrodynamic tower conveys fresh air in and exhaust gasses out while traveling submerged sufficiently deep to avoid wave undulation. Dual electronic controls in a tower bridge and in a main bridge are provided for larger vessels. A crane with automatically-adjustable weight balancing and electronic controls is telescoped from within the vessel. A shore ramp and a ship ramp are provided for fast and convenient motorized handling of commercial or military cargo at beaches and shores without docks. Special hydrodynamic configuration and contouring result in less drag-per-length coefficient of marine vessels, resulting in less ton-mile propulsion costs than for optimized displacement-hull ships.

BRIEF DESCRIPTION OF THE DRAWINGS

This invention is described by appended claims in relation to a description of preferred embodiments with reference to the following drawings wherein:

DESCRIPTION OF THE PREFERRED EMBODIMENTS

Figure 1:
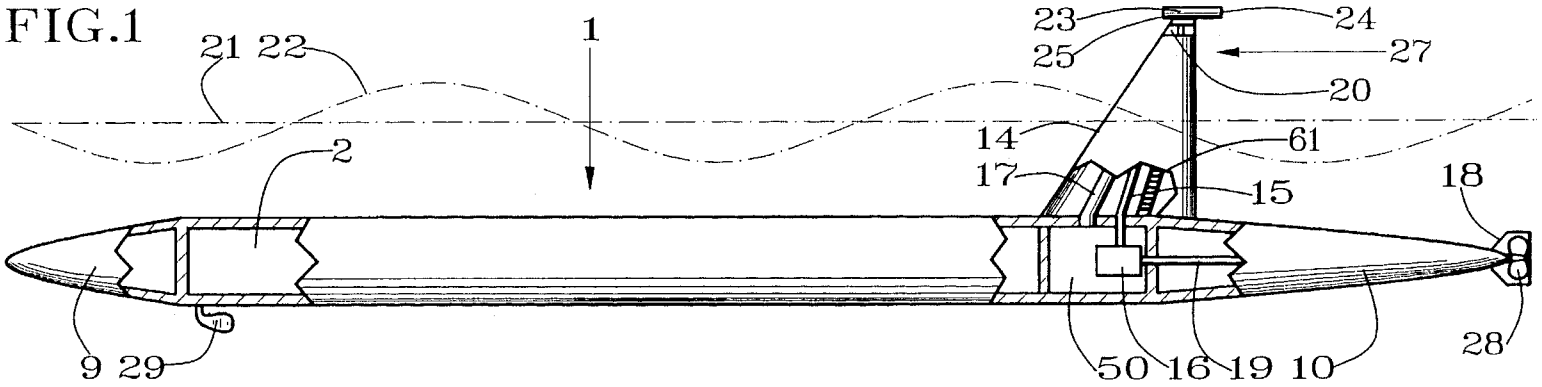
FIG. 1 is a cutaway side view of this cargo submarine traveling under high-wave undulation with surface-air communication and tower-bridge control.
Figure 2:
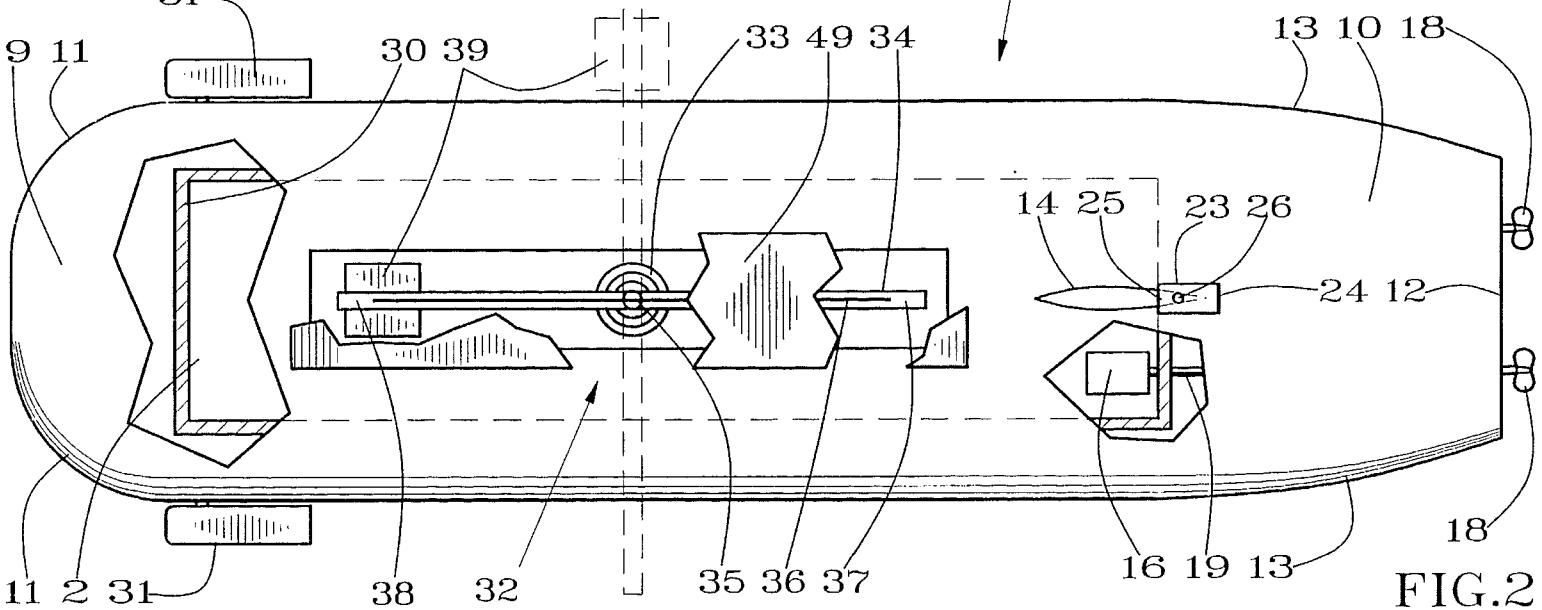
FIG. 2 is a cutaway top view of the FIG. 1 illustration.
Figure 3:
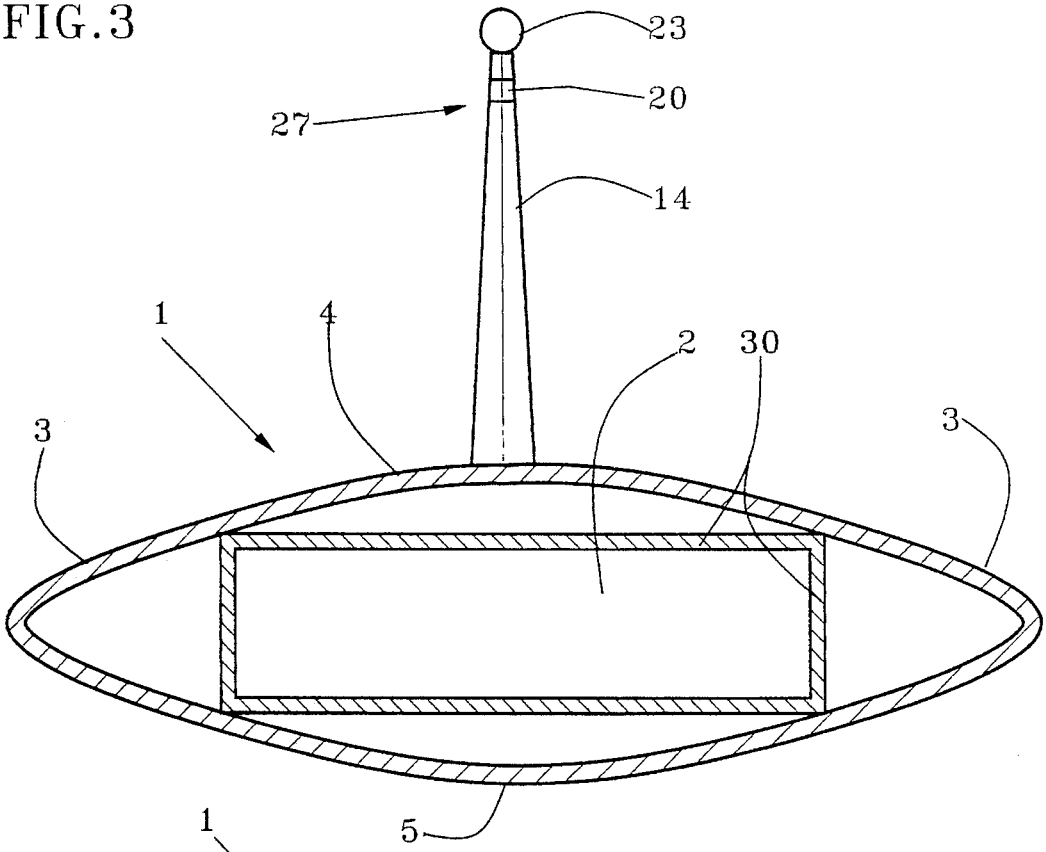
FIG. 3 is a cross-sectional layout view at a midsection of a preferred embodiment.
Figure 4:
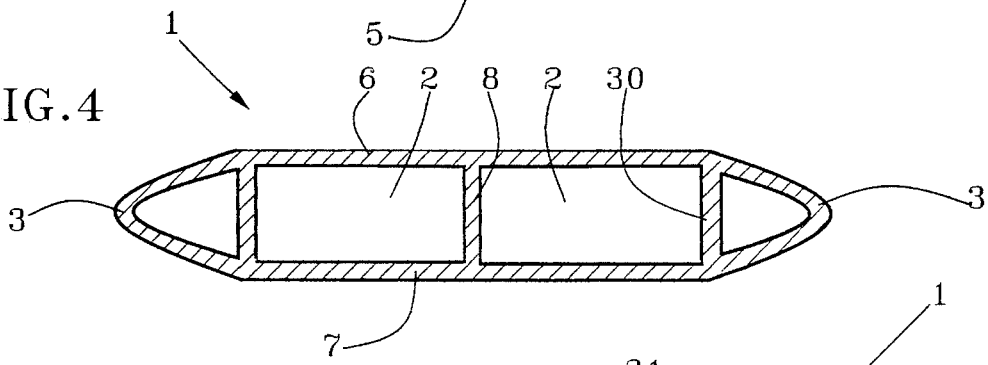
FIG. 4 is a cross-sectional layout view at a midsection of an optional flat-body embodiment.

Reference is made to FIGS. 1–5. A side-tapered submarine hull 1 is provided with cargo hold 2 between tapered hull sides 3. An elliptically-arced top surface 4 and an elliptically-arced bottom surface 5 can be employed to provide circular or arched structural integrity as illustrated in FIG. 3. Taper of hull sides 3 is elliptical along lines of the elliptically-arced top and bottom surfaces 4 and 5 respectively.

Figure 7:
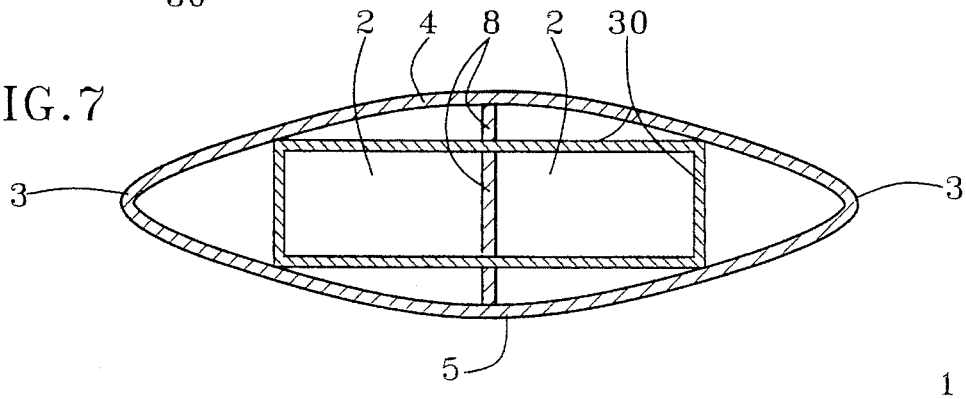
FIG. 7 is a cross-sectional layout view of a midsection of an optional deeply-submersible embodiment.

Beam technology can be employed the same as for conventional submarine and aircraft construction. An optional flat top surface 6 and an optional flat bottom surface 7 can be employed for relatively shallow-submersion applications. Sectional support members 8 can be positioned as appropriate in accordance with established engineering principals. More structural members 8 are required for flat than for arcuate top and bottom surfaces. However, for military applications requiring relatively deep submersion to avoid detection, sectional support members 8 can be employed with elliptically-arced top and bottom surfaces 4 and 5 as illustrated in FIG. 7. The bow 9 and stern 10 are tapered vertically with more acute, selectively-elliptical leading and trailing edges respectively than tapered hull sides 3. Taper of the stern 10 is more acute and longer than taper of the bow 9 in order to provide adequate resistance to drag from low-ratio return of water parted by the bow 9. Bow side corners 11 can be rounded or curved appropriately in proportion to vertical taper for parting water in evenly-scaled increments between opposite side corners 11. The stern 10, however can have a straight trailing edge 12 aft of suitably-curved stern corners 13.

This submarine hull is horizontally hydrofoil-shaped in contrast to vertically hydrofoil shapes of displacement-hull surface vessels or round pointed shapes of recent atomic-powered submarines. The vertically-hydrofoil shape of surface vessels creates waves which must be returned to normal with work load that results in approximately three times as much drag work load as parting water to make the waves with a bow of a ship having optimized design configuration. Gravitational pull of the Earth in opposition to gravitational pull of the moon and the viscosity of water affect the wave-making and wave-returning drag factors that affect marine propulsion.

These same wave factors apply to submarine vessels in different proportions owing to roundness of shape and mass of water above a submerged vessel. Roundness and arcuate contours decrease wave-making in proportion to width-expansion ratio as a result of vertical increase in taper simultaneously with horizontal increase. Water mass above a submerged vessel decreases work load loss of returning waves. Thus a round submarine can be more blunt-nosed than a super tanker per propulsive power.

Roundness and bluntness increase load volume of a vessel in proportion to mass and surface area of its hull. A decrease in surface area decreases skin friction. Skin friction, however, is far less significant than wave factors in creating drag.

Net effect of these factors on submarine configuration is less length-per-power requirements below 500 feet long. This explains in part why submarines generally are constructed shorter than surface vessels.

For similar reasons, this cargo submarine can be shorter than surface vessels per power requirements. Additionally, its horizontally-tapered configuration disperses its wave factors over a broader surface in proportion to its size. This decreases yet further its coefficient of drag per volume and length.

The weight and costs of the portion of a surface vessel above its water-line are equal to or greater than weight and costs of forming a submarine enclosure above its un-submerged waterline. Therefore, the costs of forming a submarine can be competitive with surface-vessel costs per size. In addition, however, this cargo submarine can be constructed with more cargo space per size, owing to its positioning between tapered walls on all sides. Consequently, its size can be less, its construction costs can be less and its propulsive-power costs can be less than for surface vessels per cargo capacity.

Referring to FIGS. 1–3, a tower 14 can be positioned with ladder 61 above an aft section convenient to access of exhaust line 15 from a prime mover 16 and an air-intake line 17 within the tower 14. Exhaust can include exhaust air from human consumption and intake air can include intake for human consumption in addition to that required for an optional air-breathing engine for powering a water screw 18 through shaft 19. The conveyance lines 15 and 17, respectively, could be equipped with water-excluding valves that would be forced shut and sealed automatically upon the intake of water through the top of said lines. At a top of the tower 14, tower-bridge windows 20 can be provided for visual observation for traveling with the hull 1 submerged below a water surface 21 to avoid significant undulation from maximum waves 22. A breather tube 23 can be swivelable at the top of the tower 14 with exhaust escaping at a downwind end 24 and intake air entering at an upwind end 25. Downwind and upwind relationship can be maintained with a wind-vane effect by positioning a breather tube swivel point 26 off-centered in the direction of the upwind end 25.

A tower bridge 27 can be supported on cargo submarines over 150 feet long. Regardless of length, however, the cabin need be large enough to support only one individual, electronic controls and communications gear. For most applications, the tower 14, the breather tube 23 and the bridge tower 27 need not be submersibly water tight. For military application, however, watertight submersibility is critical to the surprise effect of submarines.

A main bridge 50 is located below the tower 14 and tower bridge 27 in the mail hull 1 of the submarine. The main bridge 50 would contain all of the same and more controls than the tower bridge 27 in order to operate all aspects of the submarine.

The tapered-hull sides 3, the tapered bow 9 and the tapered stern 10 can be employed for containing various types and forms of buoyancy and trim tanks. The elliptically-arced bottom surface 5 can be employed for containing buoyancy tanks with particularly-stabilizing effect due to its bottom location.

Also, as shown in FIG. 1, a drag-reduction shield 60 can be attached to the top of the submarine hull 2. This shield 60 will work similarly to a truck cab shield to reduce drag caused by water when the submarine moves forward through the water. Such a drag reduction shield 60 could be located twenty (20) yards in front of the tower 27 and have a height of approximately one-quarter (¼) the height of the tower 27. This shield device 60 could be removable or even stand alone for after-market use on existing submarines for improved efficiency by reduction of drag.

The elliptically-arced top surface 4, however, is most effectively employed for light storage containment. In large cargo submarines, height under the top surface 4 is sufficient for upright human entry. In still larger cargo submarines, it is sufficient to support increased height of cargo hold 2. Like space beneath the top surface 4, the tower also can have a low-weight buoyancy effect.

Figure 5:
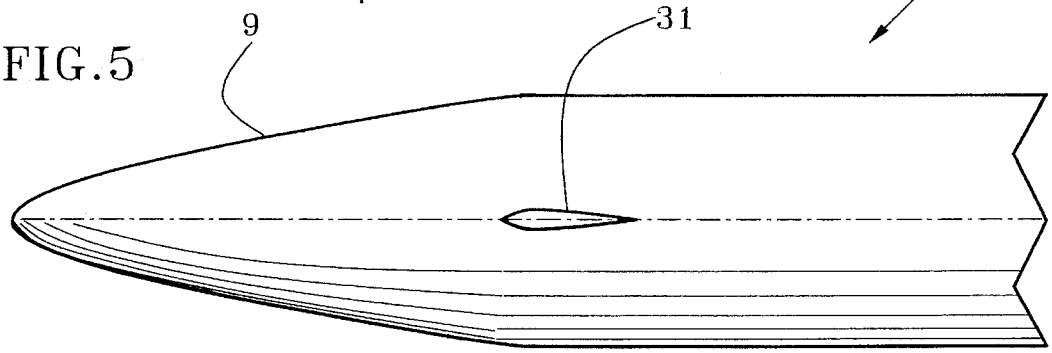
FIG. 5 is a front sectional view.

Aft steering rudders 28 can be positioned in convenient proximity to water screw 18. An optional forward steering rudder 29 can be positioned preferably proximate to the confluence of a bow 9 and rectangular hold walls 30. The forward steering rudder 29 is preferably swivelable or flexible sufficiently to avoid damage from possible shore conditions with or without docking facilities. Optional front stabilizer hydrofoils 31 also can be sufficiently flexible to avoid damage in unprotected positions. The stabilizer hydrofoils 31 are positioned preferably at vertical midsection of the hull 1 as illustrated in FIG. 5. These steering and mobilizing members may be made swivelable and flexible by mounting said members in a hinge-like fashion and making them of a resilient polymer material.

Figure 6:
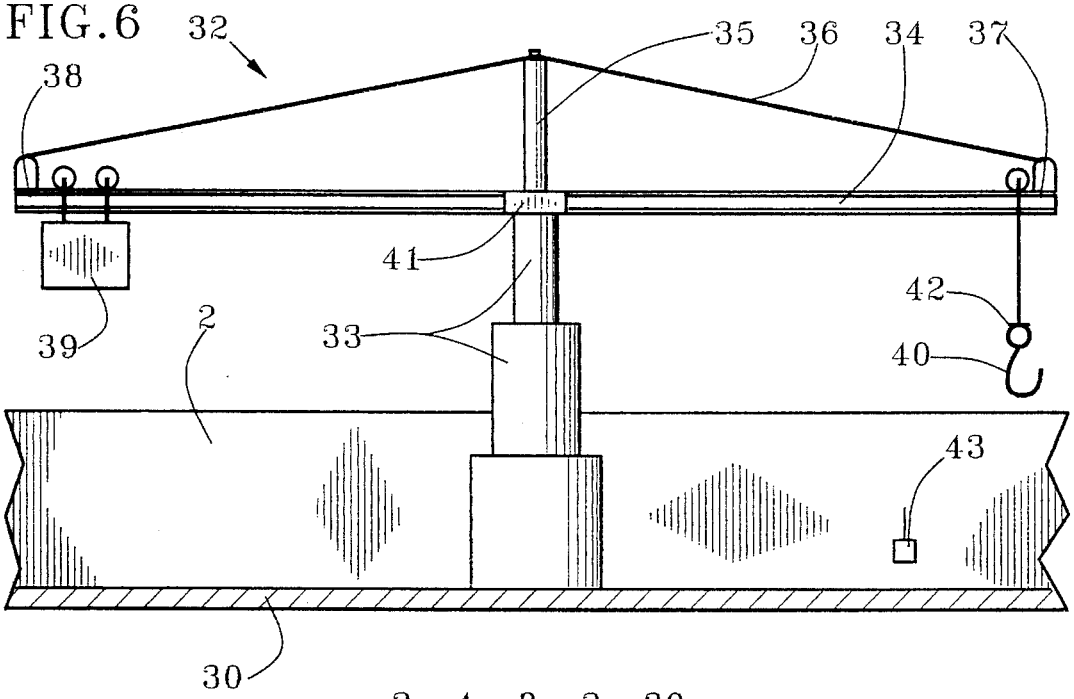
FIG. 6 is a sectional elevation view of a telescoped crane.
Figure 8:
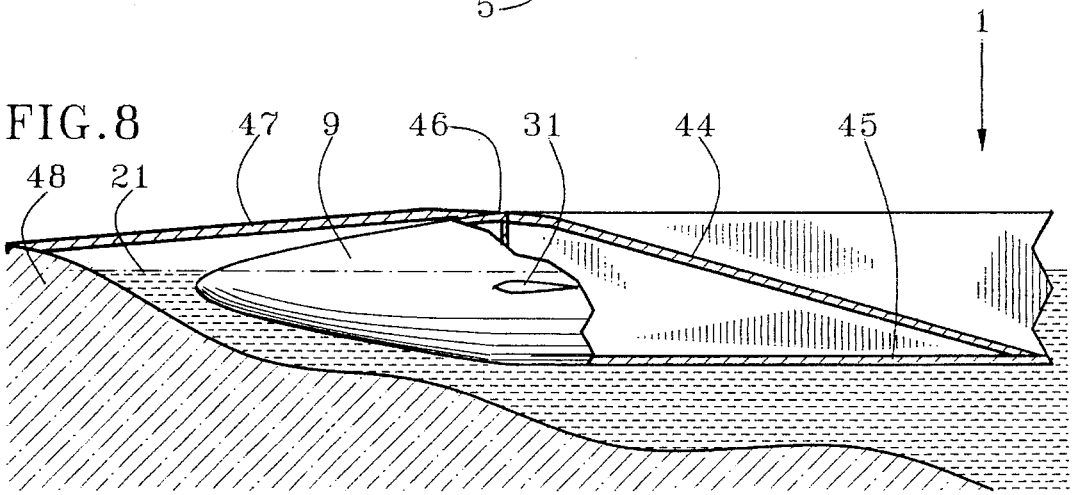
FIG. 8 is a front sectional cutaway view of this cargo submarine with inside and outside ramps in ramp-loading-and-unloading relationship to a beach or shore without docking facilities.

Referring primarily to FIGS. 2, 6 and 8, a cargo-handling means can be a crane 32 with a telescoped crane tower 33 with which crane beam 34, a guy mast 35 and guy line 36 are raised to support a load end 37 and a balance-weight end 38 of the crane beam 34 with minimized structural mass. A balance weight 39 can be positionable automatically on the crane beam 34 according to weight and positioning of a load on a load-attachment means 40 such as a cargo hook illustrated. Remote electronic controls with radio wave communication can be utilized to swivel the crane beam 34 at swivel point 41 and to position load attachment means 40 linearly on the crane beam 34. One individual can operate either loading or unloading of this entire cargo submarine with the crane 32 by consecutively loading the cargo hook, mounting a hood platform 42, signaling positioning of the load-attachment means 40, riding with the load to a load-transfer position either on or off the vessel, releasing the load and then riding the platform 42 back for another load in the opposite direction of either on or off the vessel. Alternatively, for faster, safer and less fatiguing work, the crane can be operated by an individual on board and another individual on a dock. Each individual can have separate units of the same radio-operating unit 43 that one individual would use if operating alone. The last to transmit instruction for the load-attachment means 40 would override the former. Only the load-attachment means 40 need be directed because the balance weight 39 would change positions automatically according to both the weight and linear positioning of the weight of a load on the load-attachment means 40.

Alternatively to or in addition to the crane 32, an inside ramp 44 can be positioned at an incline between a bottom deck 45 and a top deck 46. Then a shore ramp 47 can be bridged between the top deck 46 and and a shore or beach 48. This ramp approach requires motorized vehicles, manual labor for carrying loads along the ramps 44 and 47. The ramp cargo means is highly adaptable. For some types of cargo involving vehicles, it is much faster and less expensive than the crane method. It is particularly effective for undeveloped port conditions and for surprise military landings.

A low profile of this cargo submarine makes feasible both the telescoped-tower crane 32 and the ramp 44 and 47 means for handling cargo.

A cargo-hold cover 49 can be contoured, shaped and recessed to avoid hold-cover drag. The cargo hold cover 49 could be opened by hydraulic means well known in the prior art, such as, a hydraulic arm pushing the cover upward and outward to one side like a door. One side or end of the cover 49 could be attached to a submarine by a hinge-like attachment typical of many doors. The size or dimension of the cover 49, as shown in FIG. 2, would depend on the length and width of the submarine hull 1, but would most likely extend from the front near the bow 9 to just forward of the tower 14. Such a size would give adequate space with which to put cargo through the cover 49 into the cargo hold 2. The entire vessel can be streamlined without protrusions or abrupt sections that increase drag.

Length of the vehicle can range from 100 feet to 1,000 feet for economical applications. As for truck in comparison to train transportation, small units 100-to-300 feet long would be practical for reaching many locations not feasible with larger units. Special-purpose units can be either shorter or longer than these most practical lengths.

Figure 9:
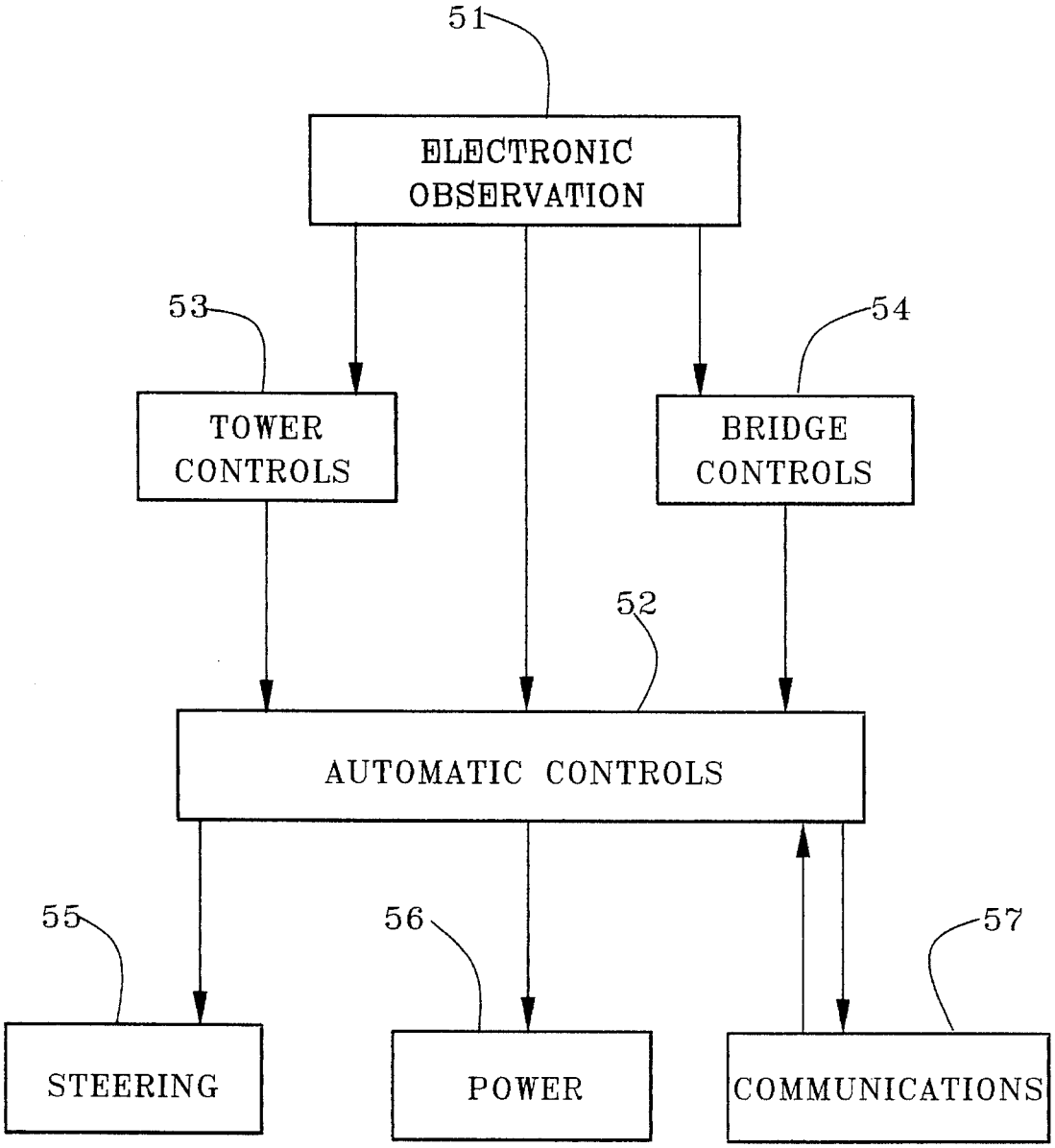
FIG. 9 is a block diagram of bridge and tower controls in relation to electronic observation and controls.

One-person control or control assistance of this cargo submarine from a tower bridge 27 with tower controls 53 or from main bridge controls 54 is outlined in box diagram illustrated in FIG. 9. Electronic observation 51 is utilized for automatic controls is 52 which can be overridden or altered by whichever of either the tower controls 53 or the bridge controls 54 which are last entered. Such regulative automatic controls 52 affect steering 55, power 56 and communications 57. Appropriate electrical power is directed to each control unit. Steering includes electrical or other powered manipulation of rudders 28 and 29 and stabilizers 31. Power includes air-breathing, atomic and battery propulsion devices. Communications includes, radio, television, radar and other possible communications methods and devices.

Figure 10:
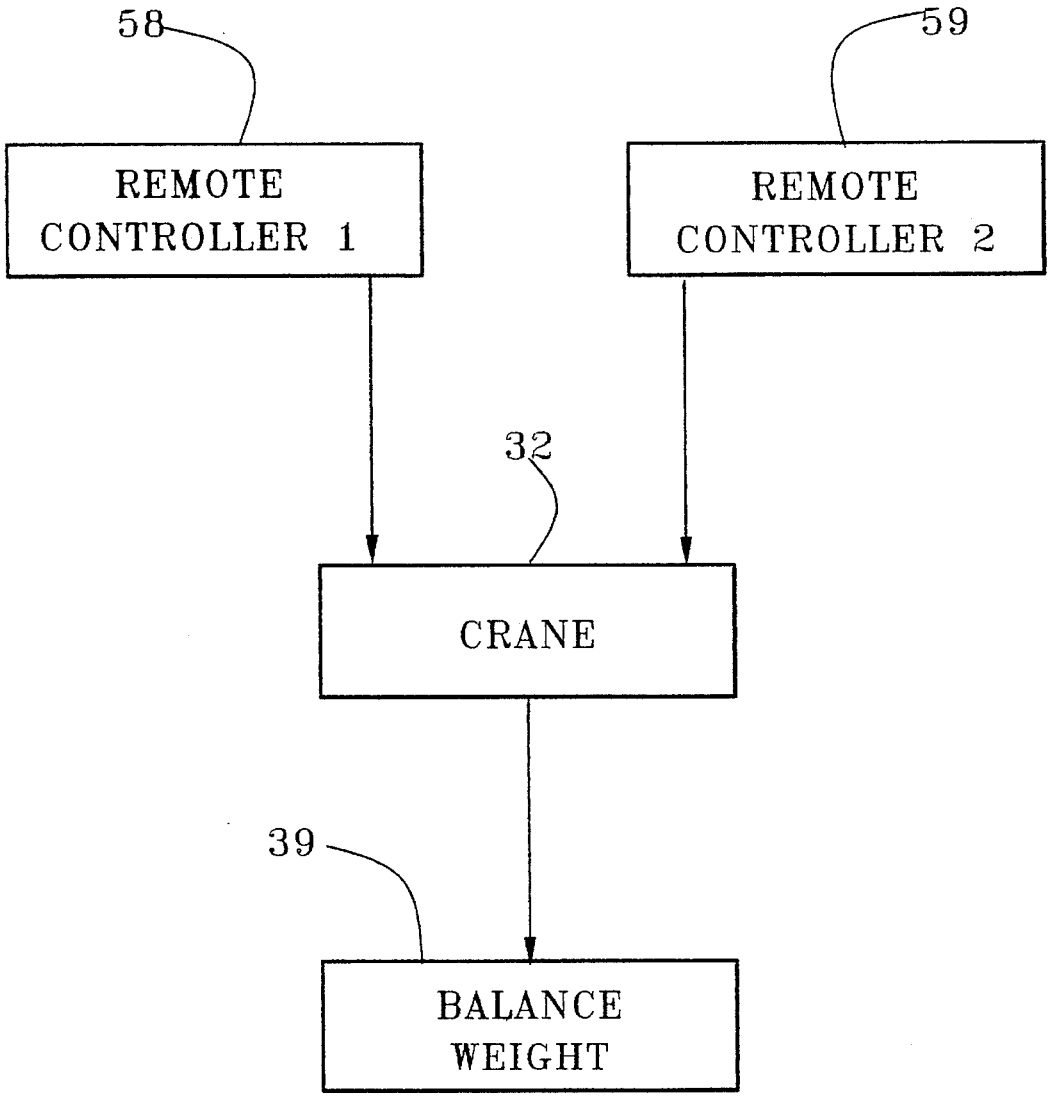
FIG. 10 is a block diagram of crane controls.

Control of the crane 32 is described in relation to a block diagram in FIG. 10. Whichever of either remote controller-1 58, or remote controller-2 59 signals instructions last to crane causes positioning action of components of the crane 32. The balance weight 39 operates automatically by computerized control in response to weight and positioning of weight on load-attachment means 40. Remote controllers 58 and 59 are separate radio units 43 operated by separate individuals.

As a result of its economy in small sizes as well as super-tanker sizes; its automated operation by one person per shift; its fast, convenient and low-cost loading and unloading in shallow water without port facilities; and its all-weather capability; this invention could affect shipping in somewhat the same way that trucks have affected trains. The Defense Department could use it for surprise landings and operations on open beaches and shores.

A new and useful cargo submarine having been described, all such modifications, adaptations, substitutions of equivalents, applications and forms thereof as described by the following claims are included in this invention.

I claim:

1. A cargo submarine comprising:

vertically-tapered and hydrodynamically-contoured buoyancy-and-trim hull sides with parallel edges between a bow section and a stern section;

a vertically-tapered and hydrodynamically-countered buoyancy-and-trim hull bow with a leading edge in a plane parallel to a vertically-tapered and hydrodynamically-contoured buoyancy-and-trim hull stern between the hydrodynamically-contoured buoyancy-and-trim hull sides;

a cargo hold positioned between the said vertically-tapered and hydrodynamically-contoured buoyancy-and-trim hull sides, the said vertically-tapered and hydrodynamically-contoured buoyancy-and-trim hull bow and the said vertically-tapered and hydrodynamically-contoured buoyancy-and-trim hull stern;

a cargo-hold cover positionable in hydrodynamically-contoured covering relationship to the cargo hold;

a cargo-handling means positionable in the cargo hold and extendible out from the cargo hold for loading freight onto and for unloading freight from the cargo submarine; and an elliptically-arced top surface of the cargo submarine in hydrodynamically-contoured relationship to the said vertically-tapered and hydrodynamically-contoured buoyancy-and-trim hull sides, the said vertically-tapered and hydrodynamically-contoured buoyancy-and-trim hull bow and the said vertically-tapered and hydrodynamically-contoured buoyancy-and-trim hull stern.

2. A cargo submarine according to claim 1 and further comprising:

an elliptically-arced bottom surface of the cargo submarine in hydrodynamically-contoured relationship to the said vertically-tapered and hydrodynamically-contoured buoyancy-and-trim hull sides, the said vertically-tapered and hydrodynamically-contoured buoyancy-and-trim hull bow and and the said vertically-tapered buoyancy-and-trim hull stern.

3. A cargo submarine according to claim 1 and further comprising:

a hydrodynamically-contoured tower extended from a top surface of the cargo submarine; and intake-air and exhaust conveyance lines in fluid communication between a top orifice in the tower and select internal portions of the cargo submarine.

4. A cargo submarine according to claim 3 wherein the top orifice is pressure-sealable against entry of water when submerged.

5. A cargo submarine according to claim 4 wherein the top orifice is pressure-sealable automatically against entry of water when inundated.

6. A cargo submarine according to claim 3 and further comprising:

ladder in the tower.

7. A cargo submarine according to claim 6 and further comprising:

a tower bridge in the tower.

8. A cargo submarine according to claim 7 and further comprising:

operational controls in the tower bridge that are mutually-overridable by operational controls in a main bridge within the hull of the cargo submarine.

9. A cargo submarine according to claim 7 and further comprising:

automatic operational controls in the tower bridge that are mutually-overridable by operational controls in a main bridge within the hull of the cargo submarine.

10. A cargo submarine according to claim 9 and further comprising:

electronic observation means in communication between the automatic controls in the tower bridge and in the main bridge.

11. A cargo submarine according to claim 3 and further comprising:

electronic observation means in communication between a top of the tower and a main bridge in the hull of the cargo submarine.

12. A cargo submarine according to claim 3 and further comprising:

a swivelable breather tube in wind-swivelable contact with the top of the tower.

13. A cargo submarine according to claim 1 and further comprising:

automatic operational controls in a main bridge.

14. A cargo submarine according to claim 1 and further comprising:

a front rudder in selectively-different steerable-direction relationship to an aft rudder of the cargo submarine.

15. A cargo submarine according to claim 1 and further comprising:

stabilizer fins at opposite sides of a frontal portion lying in a horizontal plane passing through the vertical center of the cargo submarine.

16. A cargo submarine according to claim 1 wherein select steering and stabilizing members are selectively flexible and resilient to avoid damage from contact with objects.

17. A cargo submarine according to claim 1 wherein the cargo-handling means is a crane having a telescoped mast telescopic from the cargo hold.

18. A cargo submarine according to claim 17 and further comprising:

a crane beam having a load end and a balance-weight end supported centrally by a guy line attached to each end of the crane beam and positioned centrally on a guy mast extendible above the telescoped mast of the crane; and a balance weight positional selectively on the crane beam in balancing relationship to a load attachable to a load-attachment means at a load end of the beam.

19. A cargo submarine according to claim 10 wherein the balance weight is positionable automatically on the crane beam in balancing relationship to a load attachable to a load-attachment means and positionable at select distances from the load end of the crane beam.

20. A cargo submarine according to claim 19 wherein operation of the load-attachment means and positioning of the load-attachment means at select distances from the load end of the crane beam are radio-wave controlled with a radio operating unit.

21. A cargo submarine according to claim 20 and further comprising:

an additional radio operating unit with mutually-overridable-control relationship to the said radio operating unit.

22. A cargo submarine according to claim 18 and further comprising:

electronic observation means in communication between a top of a tower and a main bridge in the hull of the cargo submarine; and electronic observation means in communication between the automatic controls in a tower bridge and in the main bridge.

23. A cargo submarine according to claim 1 wherein the cargo-handling means is an inside ramp positionable in inclined relationship between a floor of the cargo hold and a top deck of the cargo submarine.

24. A cargo submarine according to claim 23 and further comprising:

shore ramp positional in bridging relationship between the top deck of the cargo submarine and a shore position separate from the cargo submarine.

25. A cargo submarine having:

vertically-tapered and hydrodynamically-contoured buoyancy-and-trim hull sides with parallel edges between a bow section and a stern section;

a vertically-tapered and hydrodynamically-contoured buoyancy-and-trim hull bow with a leading edge parallel to a vertically-tapered and hydrodynamically-contoured buoyancy-and-trim hull stern between hydrodynamically-contoured corner junctions with the vertically-tapered and hydrodynamically-contoured buoyancy-and-trim hull sides;

a cargo hold positioned between the said vertically-tapered and hydrodynamically-contoured buoyancy-and-trim hull sides, the said vertically-tapered and hydrodynamically-contoured buoyancy-and-trim hull bow and the said vertically-tapered and hydrodynamically-contoured buoyancy-and-trim hull stern;

a cargo-hold cover positionable in hydrodynamically-contoured covering relationship to the cargo hold;

cargo-handling means positionable in the cargo hold and extendible out from the cargo-hold for loading and unloading the cargo submarine with freight cargo;

an elliptically-arced top surface of the cargo submarine in hydrodynamically-contoured relationship to the said vertically-tapered and hydrodynamically-contoured buoyancy-and-trim hull sides, the said vertically-tapered and hydrodynamically-contoured buoyancy-and-trim hull bow and the said vertically-tapered and hydrodynamically-contoured buoyancy-and-trim hull stern;

an elliptically-arced bottom surface of the cargo submarine in hydrodynamically-contoured relationship to the said vertically-tapered and hydrodynamically-contoured buoyancy-and-trim hull sides, the said vertically-tapered and hydrodynamically-contoured buoyancy-and-trim hull bow and the said vertically-tapered and hydrodynamically-contoured buoyancy-and-trim hull stern;

a hydrodynamically-contoured tower extended from a top surface of the cargo submarine; and intake-air and exhaust conveyance lines in fluid communication between a top orifice in the tower and select internal portions of the cargo submarine.

26. A cargo submarine according to claim 25 wherein the top orifice is pressure-sealable automatically against entry of water when inundated.

27. A cargo submarine according to claim 25 and further comprising;

a ladder in the tower;

a tower bridge in the tower; and operational controls in the tower bridge that are mutually-overridable by operational controls in a main bridge within the hull of the cargo submarine.

28. A cargo submarine according to claim 27 and further comprising:

automatic operational controls in a main bridge;

operational controls in the tower bridge that are mutually-overridable by operational controls in the main bridge within the hull of the cargo submarine.

29. A cargo submarine according to claim 25 wherein the cargo-handling means is a crane having a telescoped mast telescopic from the cargo hold, said crane comprising:

a crane beam having a load end and a balance-weight end supported centrally by a guy line attached to each end of the crane beam and positioned centrally on a guy mast extendible above the telescoped mast of the crane; and a balance weight positional automatically on the crane beam in balancing relationship to a load attachable to a load-attachment means at a load end of the beam and positionable at select distances from the load end of the crane beam.

30. A cargo submarine according to claim 29 wherein operation of the load-attachment means and positioning of the load-attachment means at select distances from the load end of the crane beam are radio-wave controlled with a radio operating unit.

31. A cargo submarine according to claim 30 and further comprising:

an additional radio operating unit with mutually-overridable-control relationship to the said radio operating unit.

32. A cargo submarine according to claim 25 wherein the cargo-handling means consists of: an inside ramp positionable in inclined relationship between a floor of the cargo hold and a top deck of the cargo submarine; and a shore ramp positionable in bridging relationship between the top deck of the cargo submarine and a shore position separate from the cargo submarine.

* * * * *